US006018839A

United States Patent [19]

Pietz

[11] Patent Number: 6,018,839

[45] Date of Patent: Feb. 1, 2000

[54] DEVICE FOR CLEANING OF TEETH

[76] Inventor: Hartfried Pietz, D-37441, Bad Sachsa, Germany

[21] Appl. No.: 09/062,444

[22] Filed: Apr. 17, 1998

[51] Int. Cl.[7] ..... A46B 9/04

[52] U.S. Cl. ..... 15/167.1; 15/201; 15/210.1

[58] Field of Search ..... 15/114, 167.1, 15/201, 210.1

[56] References Cited

U.S. PATENT DOCUMENTS

| | | | |
|---|---|---|---|
| 1,248,675 | 12/1917 | Kowinsky | 15/210.1 |
| 2,172,600 | 9/1939 | Van Der Worth | 15/210.1 |
| 4,184,221 | 1/1980 | Edwards | 15/114 |
| 5,138,734 | 8/1992 | Chung | 15/167.1 |
| 5,524,319 | 6/1996 | Avidor | 15/167.1 |
| 5,546,626 | 8/1996 | Chung | 15/167.1 |

FOREIGN PATENT DOCUMENTS

| | | |
|---|---|---|
| 29501338U1 | 8/1995 | Germany . |
| 19607742A1 | 8/1996 | Germany . |

*Primary Examiner*—Terrence R. Till
*Attorney, Agent, or Firm*—Womble Carlyle Sandridge & Rice

[57] ABSTRACT

A device for the cleaning of teeth is disclosed. The device comprises a cleaning device having an elastically supported deformable surface. The surface of the cleaning device is formed by a cleaning fleece.

13 Claims, 1 Drawing Sheet

DEVICE FOR CLEANING OF TEETH

FIELD OF THE INVENTION

This invention relates in general to devices for the cleaning of teeth. More particularly, this invention relates to a device for the cleaning of teeth comprising a cleaning device having an elastically supported deformable surface.

BACKGROUND OF THE INVENTION

Devices for the cleaning of teeth serve for removing impurities from the surface of the teeth and from regions between the teeth.

A device of the type mentioned above is disclosed in U.S. Pat. No. 5,318,352. As shown in FIG. 1, the device is a tooth brush comprising a handle and a head arranged at one end thereof. On the head, a cleaning means is provided, the surface of which is formed by a plurality of groups of bristles. The groups of bristles extend perpendicularly with respect to a plane of the head and parallelly to each other and are fixed in cups. The cups are supported elastically in sockets in the head by means of springs. Thus, each group of bristles is movable normal to the plane of the head independently of the other groups of bristles. In that way, the distance between the surface of the cleaning means and the groups of bristles can be varied. Consequently, the surface of the cleaning means formed by the ends of the groups of bristles is deformable. Thus, in the use of the tooth brush, the surface of the cleaning means adapts to inequalities of teeth and gums within the range of spring. In the use of groups of bristles, it is disadvantageous that each group of bristles only comes in punctual contact with the teeth. In order to attain a sufficient cleaning result, the user has to move the bristles several times across surface of the teeth. This results in a long cleaning term and possible hurt of the gums.

Another device of the type mentioned above is used for polishing teeth in professional dental treatment. The device comprises a cylindrical cleaning means made of rubber mounted on a cylindrical body. One end of the cylindrical body may be clamped in a burr. In order to polish, a polishing paste is applied on the teeth to be polished, the burr is activated, so that the body with the cleaning means rotates at high speed about its longitudinal axis, and the rotating surface of the cleaning means is brought into contact with the surfaces of the teeth to be cleaned. It is not possible to clean regions between the teeth or between the teeth and the gums, because the surface of the cleaning means only adapts to the surface to be cleaned to a very small extend. A contact with the gums in combination with the high number of revolutions would cause the gums to hurt. However, the expenditure of device is very high so that a private use is not appropriate.

Thus, what is needed, but seemingly unavailable in the art is a device for the cleaning of teeth which provides a thorough, quick and gentle cleaning of teeth.

SUMMARY OF THE INVENTION

Briefly described, the present invention provides an improved device for the cleaning of teeth which overcomes some of the design deficiencies of other devices for the cleaning of teeth known in the art by providing a surface of a cleaning means which is formed by a cleaning fleece.

The invention starts with the idea of replacing conventional punctually working groups of bristles by a novel planiformly working cleaning fleece for the cleaning of teeth. With such a cleaning fleece it is possible to attain a planiform contact between the surface of the cleaning means formed by the cleaning fleece and the surface of the teeth to be cleaned. This planiform contact has the result of a dramatic shortening of the cleaning term because of a single moving of the cleaning fleece across the surfaces of the teeth to be cleaned is sufficient. Because of its deformability and its elastic support, the surface of the cleaning fleece adapts exactly to the shape of the tooth to be cleaned. The cleaning fleece adapts to the region between teeth and gums in a way that this region is also cleaned. The short cleaning term and the relatively soft surface of the cleaning fleece prevent possible hurt of the gums. An optimum contact with the surface of the teeth, especially in the region between the teeth, the fissures and the sulcus is provided. By the elastic support of the surface of the cleaning fleece, the pressure on the surface of the teeth is equally distributed, so that no grooves occur in the region of the neck of the tooth.

The novel device of this invention may comprise an opening for a finger. Using this opening, the device can be put on a finger. The device may be formed by an elastic finger stall or a rigid thimble. The whole finger stall or thimble or just a part of it is formed by the cleaning fleece. Thus, the device has minimum dimensions, which is especially advantageous in the use during travel or in transit. A handle is not needed.

The cleaning fleece may be located at one end of a handle of a hand device. The hand device may be straight or curved and rigid or flexible. The hand device permits a cleaning of regions in the mouth which are hard to access.

A head at the end of the hand device and members extending perpendicularly or laterally from the head may be provided, the members being resiliently supported on the head and the members being surrounded by the cleaning fleece in the area of their faces. In this manner, an elastic support of the cleaning fleece is realized. The resiliently supported members make sure that the cleaning fleece with its surface adapts to the surface of the tooth to be cleaned and a planiform contact is realized. The members are at least surrounded by the cleaning fleece in the area of their faces, so that no direct contact of the members and the teeth or gums is possible and hurt is prevented.

The cleaning fleece may be positioned to sealingly surround the members completely. Thus, a penetration of tooth paste, water or impurities in between the members is prevented. The cleaning of the device and the cleaning fleece is simplified and the movability of the members is remained.

The cleaning fleece may be located on a frame connectable to the head and detachable from the head. The frame may be designed to slide on the head form-fitly. For a secure fit, common connecting means, e.g. screw or snap connections can be used. In order to detach the cleaning fleece, the connecting device has to be released so that the frame can be detached from the head. Thereafter, a different frame with a different cleaning fleece or the same frame with a different or the same cleaning fleece can be put on the head. The used cleaning fleece may be cleaned for example by way of a steam cleaning device.

The cleaning fleece may be deformable in all directions. Thus, the cleaning fleece perfectly evens out all inequalities in all directions, which is especially useful in the cleaning of regions in between the teeth.

The cleaning fleece may be made of a web of natural fibers or synthetic fibers. For these purposes, natural fibers, e.g. cotton, silk or wool and synthetic fibers, e.g. polyester, foamed material with additional fibers or different textile fabrics are suitable. As well, combinations of different materials are possible.

The cleaning fleece may comprise a rough cleaning layer, an elastic resiliency layer and an elastic and compression-proof safety layer. The cleaning layer is in direct contact with the surfaces of the teeth to be cleaned. Underneath the cleaning layer, the elastic resiliency layer is provided which ensures an optimum distribution of the pressure applied on the surfaces to be cleaned. Finally, underneath the resiliency layer, the elastic and compression-proof safety layer is provided which is very firm, solid and close meshed but also elastic. The safety layer prevents a destruction of the resiliency layer and the cleaning layer in case of the applied pressure being very high.

The cleaning layer may comprise pores, loops or free ending fibers. Thus, the cleaning surface is made of a material, e.g. velour which at least at its surface comprises the rough pores, loops or free ending fibers.

The members may be guided perpendicularly to the surface of the head by spiral springs arranged in cups in the head. Spiral springs have a relatively high spring excursion. Instead of spiral springs, an elastic material, e.g. latex or a membrane element made of rubber also can be used.

The members may be pins made of metal or break-proof plastic. In this way, they comprise a high breaking strength and they can be charged with high pressure without the danger of a destruction.

The members may comprise rounded ends. This prevents a destruction of the cleaning device.

Therefore, it is an object of the present invention to provide an improved device for a thorough, quick and gentle cleaning of teeth.

This object, features and advantages of the invention will become apparent upon reading the specification when taken into conjunction with the accompanying drawings wherein like characters of reference designate corresponding parts throughout the several views.

DETAILED DESCRIPTION

Figure 1:
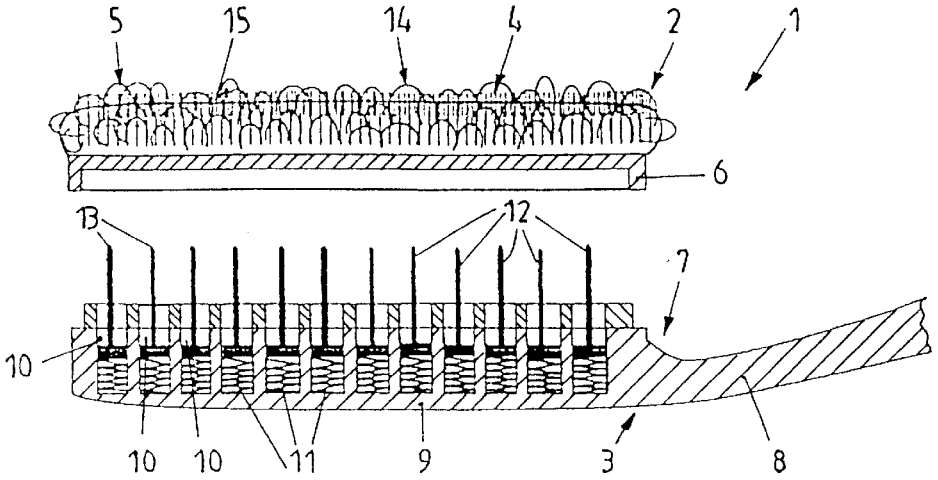
FIG. 1 is a sectional view of a first embodiment of the device of this invention.

Referring now in detail to the drawings, in which like numerals indicate like parts throughout the several views, FIG. 1 shows a device 1 for the cleaning of teeth comprising a cleaning device 2 and a hand device 3. Cleaning device 2 comprises a cleaning fleece 4 with a surface 5. Cleaning fleece 4 is connected to the edge of a frame 6 being slidable on a head 9 located at the end 7 of a handle 8 of the hand device 3. Springs 11 are arranged in cups 10 in head 9, springs 11 being firmly connected to members 12. Members 12 extend perpendicularly to the surface of head 9 of hand device 3 and serve for an elastic support of the surface 5 of cleaning fleece 4 by members 12 and their faces 13. In case of frame 6 of cleaning device 2 being mounted on head 9 of hand device 3, faces 13 of members 12 come into contact with the lower surface of cleaning fleece 4. Cleaning fleece 4 comprises a rough cleaning layer 14 at its surface 5, the rough structure of which is formed by loops 15.

Figure 2:
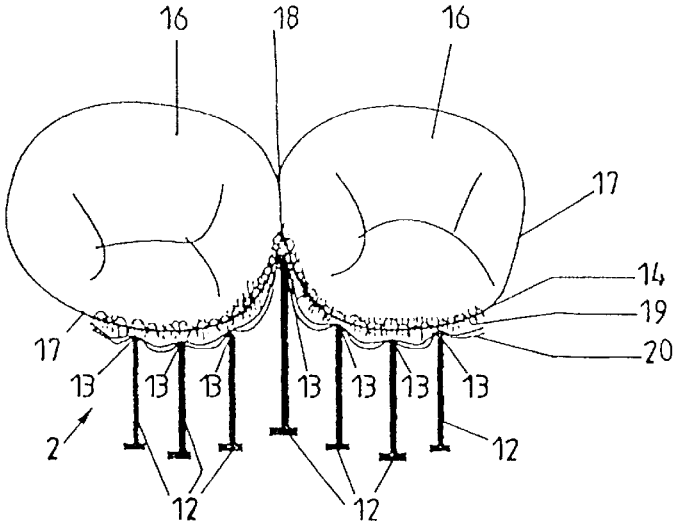
FIG. 2 is a sectional view of the device of FIG. 1 in use.

In FIG. 2 parts of device 1 are shown in use, i.e. in contact with teeth 16. Surface 5 of the cleaning fleece 4 is in planiform contact with surfaces 17 of teeth 16. By the different excursion of members 12, surface 5 of cleaning fleece 4 also comes into contact with a region 18 between teeth 16. Thus, also region 18 between teeth 16 is cleaned in a planiform manner, without pressure being supplied on the other regions of surfaces 17 of teeth 16 getting too high. Cleaning device 2 comprises a roughly structured cleaning layer 14 coming into contact with surfaces 17 and teeth 16 in a planiform manner, an elastic resiliency layer 19 and an elastic end compression-proof safety layer 20 coming into contact with faces 13 of members 12. Safety layer 20 has the function of transmitting the force applied by handle 8, head 9, springs 11, members 12 and faces 13, without the danger of a destruction caused by a penetration of faces 13 of members 12 into safety layer 20. Resiliency layer 19 has the function of providing an equal distribution of the force and consequently a steady contact of cleaning layer 14 with surface 17 of teeth 16.

Figure 3:
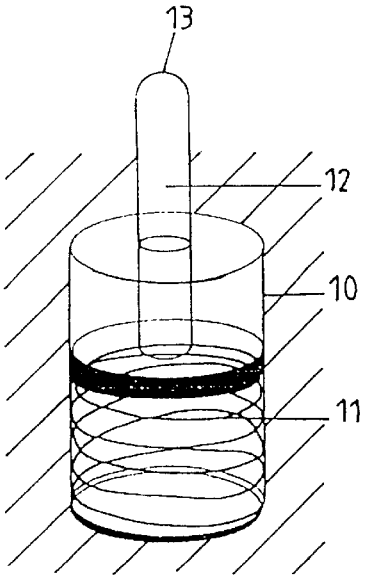
FIG. 3 is a perspective view of a member of the device of FIG. 1.

FIG. 3 shows a detail of device 1. Member 12 is supported in a downward direction by spring 11 arranged in cup 10, spring 11 being supported with its lower end on the lower end of cup 10.

I claim:

1. A device for the cleaning of teeth comprising:

(a) a hand device including a handle and a head;

(b) a plurality of members extending substantially perpendicular from said head of said and device, said members being resiliently supported on said head; and (c) a cleaning device being connectable to said head of said and device, said cleaning device having an elastically supported deformable surface being formed by a cleaning fleece surrounding said members at least in the area of their faces, said cleaning fleece including a rough cleaning layer and an elastic and compression-proof safety layer.

2. The device of claim 1, wherein said cleaning fleece is located on a frame connectable to said head and detachable from said head.

3. The device of claim 2, wherein said cleaning fleece is located on a frame connectable to said head and detachable from said head.

4. The device of claim 1, wherein said cleaning fleece is deformable in all directions.

5. The device of claim 1, wherein said cleaning fleece is made of a web of natural fibers or synthetic fibers.

6. The device of claim 1, wherein said cleaning fleece further includes an elastic resiliency layer being arranged between said cleaning layer and said safety layer, wherein said cleaning fleece comprises a rough cleaning layer, an elastic resiliency layer and an elastic and compression-proof safety layer.

7. The device of claim 6, wherein said cleaning layer includes loops.

8. The device of claim 6, wherein said cleaning layer includes free ending fibers.

9. The device of claim 6, wherein said cleaning layer includes pores.

10. The device of claim 1, wherein said members are guided perpendicularly to said head by spiral springs arranged in cups in said head.

11. The device of claim 10, wherein said members are pins made of metal.

12. The device of claim 11, wherein said members have rounded ends.

13. The device of claim 10, wherein said members are pins made of break-proof plastic.

* * * * *